United States Patent [19]

Hartwell

[11] Patent Number: 4,652,005

[45] Date of Patent: Mar. 24, 1987

[54] LIGHTWEIGHT WHEELCHAIR

[75] Inventor: Gregory W. Hartwell, Santa Rosa, Calif.

[73] Assignee: Peterson, Wicks, Nemer & Kamrath, P.A., Minneapolis, Minn.

[21] Appl. No.: 663,562

[22] Filed: Oct. 22, 1984

[51] Int. Cl.[4] ..... A61G 5/02

[52] U.S. Cl. ..... 280/242 WC; 280/657; 297/DIG. 4; D12/131

[58] Field of Search ..... 280/242 WC, 647, 650, 280/289 WC, 657, 47.38, 281 LP; 297/DIG. 4; D12/131

[56] References Cited

U.S. PATENT DOCUMENTS

| | | | |
|---|---|---|---|
| D. 161,112 | 12/1950 | Linquist | D12/131 |
| D. 254,192 | 2/1980 | Houzyou | D12/131 |
| 909,411 | 1/1909 | Hockney | 297/DIG. 4 |
| 998,706 | 7/1911 | Marshall | 280/242 WC |
| 2,653,649 | 9/1953 | Linquist | 155/30 |
| 2,713,891 | 7/1955 | Linquist | 155/152 |
| 3,103,384 | 9/1963 | Zivi | 297/DIG. 4 |
| 3,214,184 | 10/1965 | Kemm | D12/132 |
| 3,301,574 | 1/1967 | Good | 297/DIG. 4 |
| 4,241,932 | 12/1980 | Hartmann | 280/265 |
| 4,360,213 | 11/1982 | Rudwick | 280/242 WC |
| 4,380,343 | 4/1983 | Lovell et al. | 280/242 WC |
| 4,477,098 | 10/1984 | Minnebraker | 297/DIG. 4 |
| 4,500,102 | 2/1985 | Haury et al. | 280/242 WC |

FOREIGN PATENT DOCUMENTS

| | | | |
|---|---|---|---|
| 0065129 | 11/1982 | European Pat. Off. | 297/DIG. 4 |

*Primary Examiner*—John J. Love
*Assistant Examiner*—Everett G. Diederiks, Jr.
*Attorney, Agent, or Firm*—Peterson, Wicks, Nemer & Kamrath

[57] ABSTRACT

A lightweight wheelchair is provided which includes a frame formed of a plurality of elongated members. The frame includes vertical polygon sides which have a generally triangular configuration. The wheelchair seat is supported above a pair of elongated axle support members which join to the rest of the frame at points near the front and back of the frame. An axle extends between the axle support members and is attached at a medial point on each axle support member. The configuration allows for flexing of the axle support members in response to shocks. The frame effectively handles loads and shock with a minimum of structural mass.

22 Claims, 4 Drawing Figures

LIGHTWEIGHT WHEELCHAIR

BACKGROUND OF THE INVENTION

The invention relates generally to wheelchairs of the type used for self-locomotion and more particularly to an improved wheelchair frame structure which is both resilient and lightweight.

The various needs and requirements of wheelchair users have resulted in a variety of styles and types of wheelchairs. The need for portability has led to numerous types of folding or collapsable wheelchairs, for example. Institutional chairs are usually heavily constructed and have wheel placements which inhibit overturning. "Sports" wheelchairs for racing, basketball and other events are designed for lightness, impact resistance, agility or other specific qualities related to their use.

Despite the variety of wheelchair designs and types, it is possible to generally catagorize certain principals of prior art wheelchair construction. Wheel placement largely determines stability, for example. Virtually all wheelchairs have been designed with the large rear drive wheels placed near the back of the chair, well behind the center of gravity, to inhibit a backward rollover by the occupant. Frames are constructed with vertical struts to transmit weight from the seat to the wheel axles. If weight is to be saved, it is usually accomplished by using lightweight metals such as aluminum. Impact resistance is achieved by reinforcement of the frame. Finally, most prior art chairs have numerous adjustments which permit the wheels and other parts to be selectively shifted relative to the frame.

Following these principals of wheelchair design, it has not heretofore been possible to arrive at a satisfactory combination of lightness, resilience, and portability together with superior agility. The problem is that the factors which promote one desirable feature generally inhibit others. Ultralight metals usually have less strength, for example, and require additional struts and other structural reinforcement. Struts, or vertical members, in turn, transmit shock from the wheels to the seat and other parts, reducing comfort and creating the need for additional reinforcement. Making a wheelchair collapsible adds considerable weight which is inconvenient for handling and transport. Similarly, provision for wheel and other adjustments adds weight. The positioning of the drive wheels for maximum stability tends to inhibit agility, making it difficult or impossible for a user to climb curbs or otherwise maneuver the wheelchair.

There is consequently a need in the wheelchair industry for an improved wheelchair. In particular, there is a need for a wheelchair which combines agility, as found in "sports" models, with exceptional lightness. There is also a need for a wheelchair in which strength and resilience are present in a frame having a minimum number of structural members. There is also a need for a wheelchair which is both conveniently portable and adaptable to specific user needs without a large amount of weight-adding hardware.

SUMMARY OF THE INVENTION

Accordingly, a wheelchair is provided of the type having a frame structure for supporting a seat and a plurality of wheels for movement. The front, sides and back of the wheelchair, as set forth below, correspond to the orientation of an occupant of the seat. In the wheelchair, the preferred frame structure comprises two frame sides formed of a plurality of elongated frame members joined together at a plurality of frame joints. Each frame side includes an elongated axle support member extending between a first frame joint near the back of the frame structure and a second frame joint near the front of the frame structure. The two frame sides are joined together by means including an axle member extending laterally between the frame sides. The axle member supports drive wheels for the wheelchair and is attached to the axle support members at a location which is between the first and second frame joints. Such construction permits the axle support members to flex between the first and second frame joints in response to shocks which occur between the axle member and the rest of the frame structure. As a result, such shocks can be readily withstood with a minimum of structural mass.

In its preferred form, the invention further includes additional side frame members having a generally triangular configuration which transfer the weight of the chair user efficiently to the ends of the axle support member. Front caster wheel supports which efficiently handle frontal impact are also provided.

DETAILED DESCRIPTION OF THE PREFERRED EMBODIMENT

Figure 1:
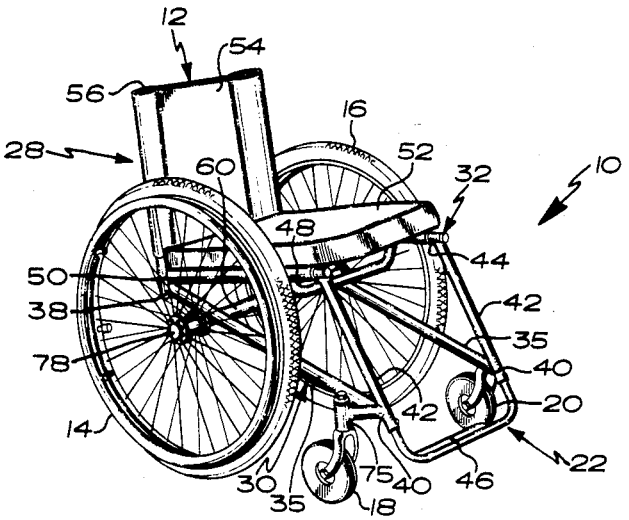
FIG. 1 is a perspective view of a wheelchair in accordance with the present invention.

Referring to FIG. 1, the wheelchair of the present invention includes a frame structure 10 for supporting a seat 12. A plurality of wheels are provided for movement, including two large rear drive wheels 14 and 16 and two small front caster wheels 18 and 20. The drive wheels 14 and 16 are preferably light-weight spoked wheels and the caster wheels 18 and 20 can be of any suitable construction, for example, polyurethane. As used in the description below, the orientation and location of the various parts and elements correspond to the orientation of an occupant of seat 12. Accordingly, the front 22, sides 30 and 32, and back 28 of the wheelchair are as shown in FIG. 1. Descriptions of the heights of various parts will be based on the wheelchair resting with the wheels on a horizontal surface.

Figure 2:
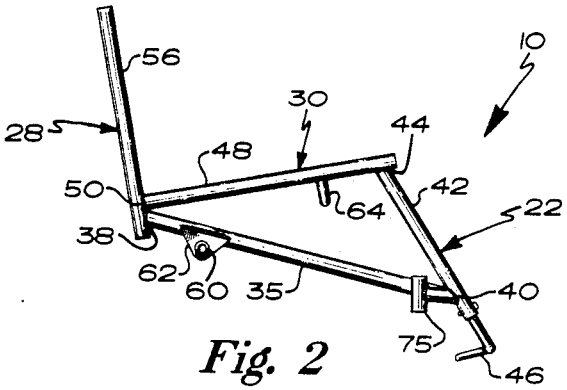
FIG. 2 is a plan view of one side of the wheelchair shown in FIG. 1, showing the frame members only.
Figure 3:
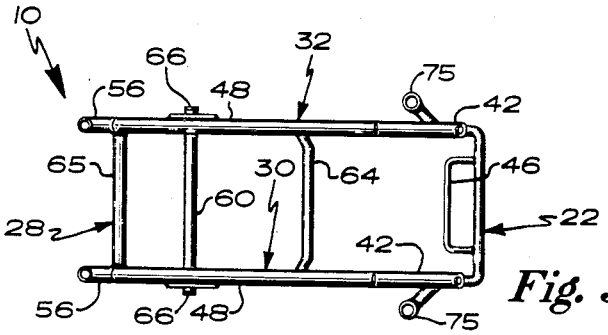
FIG. 3 is a top plan view of the wheelchair shown in FIG. 1, showing the frame members only.

The present invention employs a frame structure illustrated in FIGS. 1, 2 and 3. The frame structure includes two frame sides 30 and 32 joined together by lateral members described more fully below. With reference to FIGS. 1 and 2, frame side 30 will be described in detail, and it should be understood that like parts on frame side 32 will have the same reference numbers in the figures as those on frame side 30.

Each frame side is formed of a plurality of elongated members joined together at frame joints. The elongated members are preferably spring steel tubing, a relatively rigid material which is both strong and lightweight. An example of a suitable steel for this purpose is 4130 Chrome Moly, made by Pacific Tube of Los Angeles, Calif. The frame joints are preferably welded joints.

Each frame side is a generally vertical planar polygon having a generally triangular configuration. At the bottom is an axle support member 35 extending between a first frame joint 38 near the back of the frame structure and a second frame joint 40 near the front of the frame structure. Axle support member 35 is a free span between joints 38 and 40, unsupported by other structural members. In particular, no vertical struts are used along the length of member 35 between joints 38 and 40. Member 35 is angled downwardly from back to front with joint 38 disposed higher than joint 40.

A footrest support member 42 extends at a downward angle from a third frame joint 44 to joint 40 to form a second side of frame side 30. Member 42, in addition to forming a structural frame element, also can be used to support a footrest 46 which extends between the frame sides at the front of the wheelchair. Footrest 46 can be either permanently or detachably attached to members 42 and can be of any suitable design. The third side of frame side 30 is seat support member 48, which extends generally horizontally between joint 44 and a fourth frame joint 50, near the back of the frame structure. Seat bottom 52 is supported by member 48. Seat 12 also includes a generally vertical seat back 54 supported by a seat back member 56, which extends upward from joints 38 and 50. The small length of member 56 between joints 38 and 50, which are closely proximate to one another, forms a short fourth side to complete the polygon shape of frame side 30, which is otherwise generally triangular.

Frame sides 30 and 32 are joined together by means shown most clearly in FIG. 3. An axle member 60 extends laterally between the frame sides and is attached to members 35 at a location which is between joints 38 and 40. Attachment can be by means of a metal plate 62 welded to member 35 and axle member 60 or by, for example, bolting axle 60 or plate 62 to members 35. The axle position can also be made conveniently adjustable by conventional means such as providing a plurality of holes (not shown) at selected locations along member 35, and bolting or otherwise fastening axle 60 through selected ones of the bolts. The position of the attachment location for axle member 60 along axle support members 35 is determined by user preference or need, with a more rearward location providing increased stability at a sacrifice in agility. Preferably, the attachment location is beneath seat bottom 52, slightly rearward of the front to rear rotational center of gravity of the wheelchair when occupied. The rotational center of gravity, as used here, would be the point where the entire weight of the chair and occupant is balanced on the rear wheel's axle and the chair will rotate freely around the axle. Having the attachment location slightly rearward of the center of gravity shifts some weight to the front caster wheels but allows the user to easily pivot the chair about axle 60 when desired; for example, to climb a curb. A second lateral member 64 extends laterally between members 48, beneath the seat. Member 64 is attached to members 48 at a point between joints 44 and 50, preferably about one-third of the way back from joint 44 along member 48. A third transverse member 65 extends laterally between seat back members 56, preferably near the lower ends of members 56, proximate to joints 38 and 50.

Figure 4:
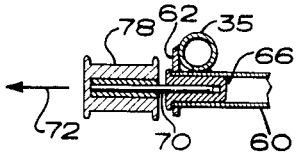
FIG. 4 is an enlarged partial cross-sectional view of a preferred drive wheel mounting means for use on the wheelchair of FIG. 1.

The large rear drive wheels 14 are preferably detachably attached to axle 60 by means illustrated in FIG. 4. A bushing 66 formed of a suitable bearing material such as Nylatron (trademark) is inserted in each open end of axle 60. Wheel hub 78 has a cooperating stub axle 70 which rides within bushing 66. To remove the wheels, each is pulled laterally sideward in the direction of arrow 72.

Each frame side also includes a front wheel support extending generally sideward out from the frame. As shown in FIGS. 1–3, front wheel supports 75, are relatively short lengths of frame material extending out from a front wheel support joint which is preferably coincident with frame joint 40. The front wheel supports 75 extend angularly out from joint 40 generally sideward and to the rear and support caster wheels 18 and 20 at the distal ends thereof. The caster wheels have generally vertically mounted pivots and can be of any suitable type. The angular mounting for supports 75 provides for improved resistance to frontal impact, as opposed to supports which extend perpendicularly from the frame sides. With a perpendicular mounting, an impact from the front of the wheelchair is transmitted as torque directly to the attaching joint. An angular mounting as shown in FIG. 3 causes a component of a frontal impact to be transmitted along the length of member 75, reducing stress on joint 40 and requiring a less massive mounting.

The construction of the present invention provides a highly resilient and maneuverable, lightweight wheelchair. Its strength and resiliency are believed to result from its novel frame construction which efficiently transmits stress. For example, the weight of an occupant is transmitted from the seat bottom to the rear wheels by way of joints 38 and 40, at opposite ends of axle support member 35. Members 42, 48 and 56 together form a seat support assembly which extends above member 35 between joints 38 and 40. The seat support assembly acts as a yoke which transmits force to what is in effect a stiff spring (member 35). Because axle 60 is attached at a medial point on member 35, member 35 is free to flex between joints 38 and 40 in response to shocks between the axle and the rest of the frame. Such flexing is believed to be the reason the chair is able to withstand relatively hard use with a minimum of structural mass.

Other advantages of the present invention over prior art wheelchairs include a very low weight. The present invention can be made to weigh under 19 pounds. It, nevertheless, has the strength to withstand use in competitive sports events. Use of a solid axle member maximizes the strength of the wheel mounts without the need for heavy plates or the like required for separate wheel mounting systems. It is also believed that the use of steel instead of aluminum saves weight, since steel is stronger, pound for pound. The triangular configuration of the frame sides is also strong and light. Since the chair is well balanced and light, it is also highly agile and maneuverable.

Alternative embodiments are possible within the scope of the present invention. The type of wheels and their mounting systems are illustrative, for example, and other types of wheels could be used. Other design considerations which could be adjusted include the height of seat back 54 and the axle location along member 35.

An improved wheelchair has been shown and described. The chair combines agility and lightness, strength and resilience, using a frame with a minimum number of structural members. Because of its lightness and its removable wheels, the chair is highly portable without the need for a large amount of weight-adding hardware.

What is claimed is:

1. A wheelchair having a frame structure for supporting a seat and drive wheels for movement, and in which the front, sides and back thereof correspond to the orientation of an occupant of such seat, the frame structure comprising: two frame sides formed of a plurality of elongated frame members joined together at a plurality of frame joints, each said frame side including an elongated axle support member extending between a first frame joint near the back of the frame structure and a second frame joint near the front of the frame structure, a seat support member extending to the back of the frame structure from a third frame joint and which is generally horizontal and located above said axle support member when the wheelchair is resting on a horizontal surface, and a footrest support member extending angularly downward toward the front of the frame structure from said third frame joint and joining with said axle support member at said second frame joint, with the seat support member, the footrest support member and the axle support member of each frame side joined together in a substantially triangular configuration, with the seat support member and the footrest support member intersecting at an obtuse angle and with the axle support member and the footrest support member intersecting at an acute angle, said two frame sides being joined together by means including an axle member extending laterally between said frame sides which support the drive wheels for the wheelchair, said axle member being attached to each said axle support member at a location which is between said first and second frame joints such that said axle support members are free to flex between said first and second frame joints in response to shocks which occur between said axle member and the rest of the frame structure whereby said shocks can be withstood with a minimum of structural mass, and in which, when the wheelchair rests on a horizontal surface, said second frame joints are lower than said first frame joints and said axle support members each extend angularly from a low point in the front to a high point in the back of the frame structure.

2. A wheelchair as in claim 1 in which said seat support members, said footrest support members and said axle support members are all substantially straight.

3. A wheelchair as in claim 1 including footrest means extending below and in front of said second frame joints supported by said footrest support members.

4. A wheelchair as in claim 1 including a wheelchair seat formed of a substantially horizontal seat bottom supported by said seat support members and a substantially vertically-extending seat back, and wherein said frame sides each further include a seat back member joined to said axle support member at said first frame joint and extending substantially vertically therefrom for supporting said seat back.

5. A wheelchair as in claim 4 in which each said frame side includes a fourth frame joint where said seat support member joins said seat back member.

6. A wheelchair as in claim 5 in which each said frame side is formed of four substantially straight members which include said seat support member, said seat back member, said axle support member and said footrest support member joined together at said first, second, third, and fourth frame joints.

7. A wheelchair as in claim 5 in which said frame sides are additionally joined together by a second transverse member extending laterally between said seat support members beneath said seat bottom.

8. A wheelchair as in claim 7 in which said second transverse member is attached to each said seat support member at a point between said third and fourth frame joints.

9. A wheelchair as in claim 2 in which said frame sides are additionally joined together by a second transverse member extending laterally between said seat support assemblies.

10. A wheelchair as in claim 1 further including means for detachably attaching said drive wheels to said axle member to permit convenient removal of said drive wheels.

11. A wheelchair as in claim 1 in which each said front wheel support member is joined to said frame side at a front wheel support joint and extends angularly out therefrom generally sideward and toward the rear of the frame structure for supporting the caster wheels at the distal end thereof.

12. A wheelchair having a frame structure for supporting a seat and drive wheels for movement, and in which the front, sides and back thereof correspond to the orientation of an occupant of such seat, the frame structure comprising: two frame sides formed of a plurality of elongated frame members joined together at a plurality of frame joints, each said frame side including an elongated axle support member extending between a first frame joint near the back of the frame structure and a second frame joint near the front of the frame structure, said two frame sides being joined together by means including an axle member extending laterally between said frame sides which support the drive wheels for the wheelchair, said axle member being attached to each said axle support member at a location which is between said first and second frame joints such that said axle support members are free to flex between said first and second frame joints in response to shocks which occur between said axle member and the rest of the frame structure whereby said shocks can be withstood with a minimum of structural mass; and a front wheel support member supporting a front caster wheel, each said front wheel support member being joined to said frame side at said second frame joint and extending angularly out therefrom generally sideward and toward the rear of the frame structure for supporting the caster wheels at the distal end thereof.

13. A wheelchair as in claim 12 in which said front wheel support joint on each said frame side coincides with said second frame joint.

14. A wheelchair having a frame structure for supporting a seat which includes a seat bottom and seat back, and in which the front, sides and back of the frame structure correspond to the orientation of an occupant of the seat, the frame structure comprising:

two frame sides each formed of a plurality of elongated members formed of relatively rigid material joined together at a plurality of frame joints such that, with the wheelchair resting on a horizontal support surface, each said frame side is a substantially vertical planar polygon formed of members which include an axle support member extending from a first frame joint near the back of the frame side angularly downward to a second frame joint relatively lower with respect to the support surface near the front of the frame structure, and a seat support assembly joined to the ends of said axle support member at said first and second frame joints and extending generally above said axle support member for supporting the seat, a front wheel support member extending outwardly and rearwardly from each said frame side for supporting a pair of front caster wheels, and wherein said frame sides are joined together by means including an axle member extending laterally between said frame sides which supports drive wheels, for the wheelchair said axle member being attached to said axle support members at a location which is between said first and second frame joints such that weight on said seat is supported substantially through said axle and the associated drive wheels at a medial point on said axle support member whereby flexing of said axle support member between said first and second frame joints serves to absorb shocks effectively with a minimum of structural mass.

15. A wheelchair as in claim 14 in which said axle member is attached to said axle support members at an attachment location which is beneath the seat bottom and slightly rearward of the front to rear rotational center of gravity of the wheelchair when occupied.

16. A wheelchair as in claim 14 in which each said seat support assembly is formed of a plurality of elongated members joined together including a seat support member extending to the back of the frame structure from a third frame joint and which is generally horizontal and located above said axle support member when the wheelchair is resting on a horizontal surface, and a footrest support member extending angularly downward toward the front of the frame structure from said third frame joint and joining with said axle support member at said second frame joint.

17. A wheelchair as in claim 16 including footrest means extending below and in front of said second frame joints supported by said footrest support members.

18. A wheelchair as in claim 16 in which each said frame side further includes a seat back member joined to said axle support member at said first frame joint and extending substantially vertically therefrom for supporting the seat back, and a fourth frame joint where said seat support member joins said seat back member.

19. A wheelchair as in claim 18 in which said frame sides are additionally joined together by a second transverse member extending laterally between said seat support members beneath said seat bottom.

20. A wheelchair as in claim 19 in which said second transverse member is attached to each said seat support member at a point between said third and fourth frame joints.

21. A wheelchair as in claim 19 in which said frame sides are additionally joined together by a third transverse member extending laterally between said seat back members.

22. A wheelchair as in claim 14 in which the elongated members forming said frame are made of tubular steel and said frame joints are welds.

* * * * *